US009026433B2

(12) United States Patent
Aoyagi

(10) Patent No.: US 9,026,433 B2
(45) Date of Patent: May 5, 2015

(54) VOICE QUALITY MEASUREMENT DEVICE, METHOD AND COMPUTER READABLE MEDIUM

(75) Inventor: Hiromi Aoyagi, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 53 days.

(21) Appl. No.: 13/304,543

(22) Filed: Nov. 25, 2011

(65) Prior Publication Data

US 2012/0197633 A1 Aug. 2, 2012

(30) Foreign Application Priority Data

Feb. 1, 2011 (JP) ..... 2011-019849

(51) Int. Cl.
*G10L 19/00* (2013.01)
*G10L 25/69* (2013.01)
*G10L 19/005* (2013.01)

(52) U.S. Cl.
CPC ..... *G10L 25/69* (2013.01); *G10L 19/005* (2013.01)

(58) Field of Classification Search
USPC ..... 704/201, 227, 228
See application file for complete search history.

(56) References Cited

U.S. PATENT DOCUMENTS

| | | | | |
|---|---|---|---|---|
| 6,678,660 | B1 * | 1/2004 | Aoyagi et al. | 704/270.1 |
| 2003/0043856 | A1 * | 3/2003 | Lakaniemi et al. | 370/503 |
| 2004/0049380 | A1 * | 3/2004 | Ehara et al. | 704/219 |
| 2008/0071530 | A1 * | 3/2008 | Ehara | 704/223 |
| 2009/0234653 | A1 * | 9/2009 | Kawashima et al. | 704/263 |
| 2010/0161086 | A1 * | 6/2010 | Andersen | 700/94 |
| 2011/0077945 | A1 * | 3/2011 | Ojala et al. | 704/262 |

FOREIGN PATENT DOCUMENTS

| | | | |
|---|---|---|---|
| CN | 1989548 | A | 6/2007 |
| JP | 6-061983 | A | 3/1994 |
| JP | 7-334191 | A | 12/1995 |
| JP | 2002164918 | A | 6/2002 |
| JP | 2003273914 | A | 9/2003 |
| JP | 2005072705 | A | 3/2005 |

OTHER PUBLICATIONS

International Telecommunication Union, ITU-T Recommendation P.564, "Series P: Telephone Transmission Quality, Telephone Installations, Local Line Networks: Opbjective measuring apparatus: Comformance testing for voice over IP transmission quality assessment models", Nov. 2007.

Chinese Ofice Action dated Nov. 5, 2013, issued in corresponding Chinese Patent Application No. 201110371147.8 with partial English Translation.

* cited by examiner

*Primary Examiner* — Leonard Saint Cyr
(74) *Attorney, Agent, or Firm* — Rabin & Berdo, P.C.

(57) ABSTRACT

A voice quality measurement device that measures voice quality of a decoded voice signal outputted from a voice decoder unit. The voice quality measurement device includes a packet buffer unit and a voice information monitoring unit. The packet buffer unit accumulates voice packets that arrive non-periodically as voice information, and outputs the voice information to the voice decoder unit periodically. The voice information monitoring unit monitors continuity of the voice information inputted to the voice decoder unit, and calculates an index of voice quality of the decoded voice signal that reflects acceptability of this continuity.

18 Claims, 2 Drawing Sheets

VOICE QUALITY MEASUREMENT DEVICE, METHOD AND COMPUTER READABLE MEDIUM

CROSS-REFERENCE TO RELATED APPLICATIONS

This application claims priority under 35 USC 119 from Japanese Patent Application No. 2011-019849 filed on Feb. 1, 2011, the disclosure of which is incorporated by reference herein.

BACKGROUND OF THE INVENTION

1. Field of the Invention

The present invention relates to a voice quality measurement device, method and computer readable medium storing a program, and may be employed in, for example, IP (internet protocol) phone terminals (including softphones).

2. Description of the Related Art

In recent years, IP phone communications, which is voice communications using VoIP (Voice over IP) technology, has become widespread. In IP phone communications, information of a voice signal is put into IP packets and the voice signals are transferred to a communication partner terminal by transmissions through an IP network. In general, real-time performance of transmissions in an IP network is not assured, and time variations of packets (jitter) and the like occur during voice packet transfers (during calls), leading to falls in call quality. Consequently, techniques for measuring conditions of voice quality are sought after. Methods for indexing voice quality on the basis of statistical information of packets transmitted during a call (statistical values of packet loss counts and jitter and the like) have been proposed, for example, as described in ITU-T, P. 564.

However, in contemporary IP phone communications, technologies that correct for time variations of packets (jitter) and the like occurring in a network are used at the receiving side. Thus, statistical information of packets passing through the network does not necessarily lead directly to an index of call quality.

SUMMARY OF THE INVENTION

A voice quality measurement device, method and program capable of conveniently measuring actual voice quality that is outputted to a listener at a receiving side are provided.

According to a first aspect of the present invention, a voice quality measurement device is provided that measures voice quality of a decoded voice signal outputted from a voice decoder unit, the device including: (1) a packet buffer unit that accumulates non-periodically arriving voice packets in a predetermined format (hereinafter referred to as voice information), and outputs the voice information to the voice decoder unit periodically; and (2) a voice information monitoring unit that monitors continuity of the voice information inputted to the voice decoder unit and calculates an index of voice quality of the decoded voice signal that reflects acceptability (good or bad) of the continuity.

According to a second aspect of the present invention, a voice quality measurement method is provided that measures voice quality of a decoded voice signal outputted from a voice decoder unit, the method including: (1) accumulating non-periodically arriving voice packets as voice information and outputting the voice information to the voice decoder unit periodically; and (2) monitoring continuity of the voice information inputted to the voice decoder unit and calculating an index of voice quality of the decoded voice signal that reflects acceptability of the continuity.

According to a third aspect of the present invention, a non-transitory computer readable medium storing a voice quality measurement program to be installed at a voice processing device that includes a voice decoder unit that performs processing based on arriving voice packets is provided, the program causing a computer installed at the voice processing device to execute a process for measuring voice quality of decoded voice signals outputted from the voice decoder unit, the process including: (1) accumulating non-periodically arriving voice packets as voice information and, when a count of voice information accumulated from a start of accumulation has reached a predetermined count, outputting the voice information to the voice decoder unit periodically; and (2) monitoring continuity of the voice information inputted to the voice decoder unit and calculating an index of voice quality of the decoded voice signal that reflects acceptability of the continuity.

According to the above aspects of the present invention, a voice quality measurement device, method and computer readable medium storing a program that are capable of conveniently measuring actual voice quality outputted to a listener at a receiving side may be provided.

BRIEF DESCRIPTION OF THE DRAWINGS

Preferred embodiments of the present invention will be described in detail based on the following figures, wherein.

DETAILED DESCRIPTION OF THE INVENTION

(A) First Embodiment

Herebelow, a first embodiment of the voice quality measurement device, method and program according to the present invention is described while referring to the attached drawings.

(A-1) Structure of the First Embodiment

Figure 1:
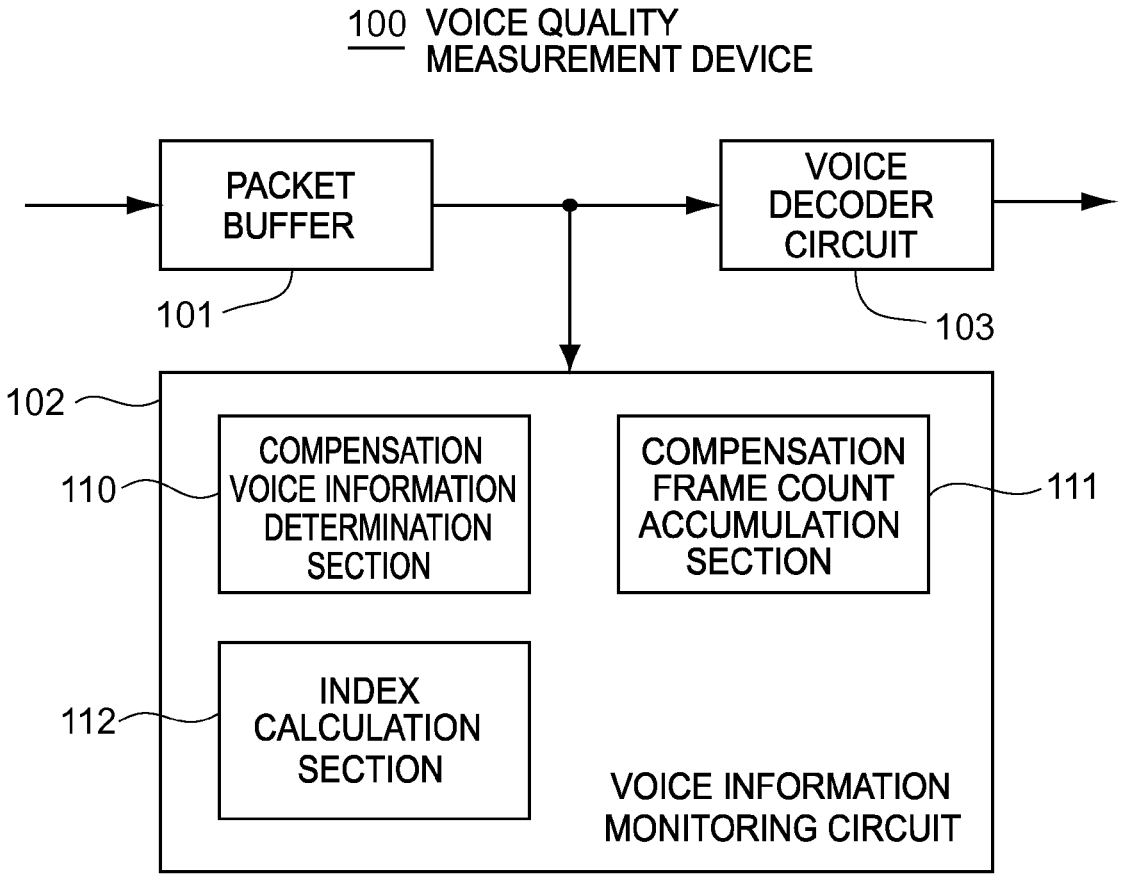
FIG. 1 is a block diagram illustrating functional structure of a voice quality measurement device relating to a first embodiment.

FIG. 1 is a block diagram illustrating functional structures of the voice quality measurement device of the first embodiment. The voice quality measurement device of the first embodiment is installed at, for example, an IP phone terminal (such as a softphone). The voice quality measurement device is implemented, with a CPU and a program executed by the CPU (the voice quality measurement program), by structures of the IP phone terminal, and may be represented by FIG. 1.

In FIG. 1, a packet buffer 101 and a voice information monitoring circuit 102 are structural elements of a voice quality measurement device 100 of the first embodiment. To make the position of the voice quality measurement device 100 in a voice signal processing sequence clear, a voice decoder circuit 103 is also drawn in FIG. 1.

The packet buffer 101 (a first in, first out memory) temporarily stores voice information that is voice packets (for example, IP packets containing encoded voice data) arriving through an unillustrated network (for example, an IP network) or information in which the voice packets are separated into voice decoder circuit processing units (voice frames).

The packet buffer 101 absorbs time variations of the voice packets. Arrival times of the voice packets are not necessarily constant. The packet buffer 101 stores voice packets or separated voice frames that arrive non-periodically and outputs the stored voice information periodically, supplying the voice information to the voice decoder circuit 103. The voice decoder circuit 103 processes the voice information that is periodically inputted. If the packet buffer 101 goes into a depleted condition in which there is no voice information to be outputted at the periodic output timings, the voice decoder circuit 103 outputs data to start loss compensation processing (compensation voice information).

The voice decoder circuit 103 decodes the encoded voice data contained in the inputted voice information and outputs a voice signal. The voice decoder circuit 103 incorporates a processing section that, if the voice decoder circuit 103 recognizes compensation voice information in the inputted voice information series, compensates that portion of the voice signal. A compensation method is not limited here; the methods described in Japanese Patent Application Laid-Open (JP-A) Nos. 6-61983, 7-334191 and the like may be employed.

The voice information monitoring circuit 102 monitors continuity of the voice information being supplied from the packet buffer 101 to the voice decoder circuit 103, and calculates and outputs a voice quality index N.

The voice information monitoring circuit 102 includes a compensation voice information determination section 110, a compensation frame count accumulation section 111 and an index calculation section 112.

The compensation voice information determination section 110 determines whether or not compensation voice information has been outputted from the packet buffer 101.

When the output of compensation voice information is determined, the compensation frame count accumulation section 111 integrates an amount corresponding to a number of frames containing the compensation voice information to a accumulated value C therein. In relation thereto, the encoding of the voice data is executed on units of voice data corresponding to single frames (a predetermined duration). The accumulated value C of the compensation frame count accumulation section 111 is cleared (reset) when a new measurement period begins.

When a measurement period (a fixed period) ends, the index calculation section 112 calculates a ratio of the accumulated value C of the compensation frame count accumulation section 111 to a number of frames M (a fixed value) that the voice decoder circuit 103 requires in the measurement period, to serve as a voice quality index N, and outputs the voice quality index N. The voice quality index N is represented by expression (1), which indicates that a deterioration in voice quality is smaller when the value of the voice quality index N is closer to zero.

$$N=C/M \tag{1}$$

If the voice quality index N should have a larger value when the voice quality is better, the voice quality index N may be, for example, as expressed in expression (2), a value for which the value C/M shown in expression (1) is subtracted from a predetermined value A (for example, 1).

$$N=A-C/M \tag{2}$$

(A-2) Operation of the First Embodiment

Next, operation of the voice quality measurement device 100 of the first embodiment (i.e., the voice quality measurement method) is described.

Non-periodic voice packets arriving through the network are stored as voice information in the packet buffer 101, either as they are or separated into voice frames. In consideration of a maximum interval between non-periodic packets arriving through the network, the packet buffer 101 operates to initially collect voice information in an amount equivalent to periodic voice information that would be required in this maximum interval (at the start), and only then start output of the voice information. As a result, depletion of the packet buffer 101 is unlikely to occur, continuity of the periodic voice information outputted from the packet buffer 101 is assured, and a deterioration in quality of the decoded voice signal subsequent to processing by the voice decoder circuit 103 is suppressed.

However, if there is a packet interval longer than expected in the network, the packet information in the packet buffer 101 is depleted and there is no packet information to be outputted. Then, the packet buffer 101 outputs data to initiate loss compensation processing in the voice decoder circuit 103 (compensation voice information). A decoded voice signal obtained by loss compensation processing at the voice decoder circuit 103 differs from a decoded voice signal obtained by decoding encoded voice data of proper packets, which leads to a deterioration in voice quality.

Accordingly, in the first embodiment, continuity of the voice information inputted to the voice decoder circuit 103 is monitored, and the voice quality index of the decoded voice signal is calculated on the basis of this continuity. More specifically, a proportion of decoded voice compensation processing (loss compensation processing) occurring in a measurement period serves as the voice quality index.

The voice quality index N is outputted from the voice information monitoring circuit 102 at intervals of the prespecified measurement period (a fixed period). When a new measurement period begins, the accumulated value C in the compensation frame count accumulation section 111 is cleared to zero.

At the voice information monitoring circuit 102, outputs of compensation voice information from the packet buffer 101 are monitored by the compensation voice information determination section 110. When compensation voice information is outputted from the packet buffer 101 and the compensation voice information determination section 110 reports this to the compensation frame count accumulation section 111, the accumulated value C is incremented by the compensation frame count accumulation section 111 by an amount corresponding to a number of voice frames included in that compensation voice information.

When the current measurement period ends, a calculation in accordance with the above-mentioned expression (1) is executed by the index calculation section 112, and the voice quality index N for this measurement period is obtained and outputted.

How the measured voice quality index N is used is an arbitrary matter. The voice quality index N may be used for reporting, or may be used for controlling operations of other circuits or the like. For example, the voice quality index N may be used as voice quality in reporting to a higher level device such as a network monitoring device or the like. As another example, the count of voice information stored before periodic output by the packet buffer 101 begins may be controlled in accordance with values of the voice quality index N.

(A-3) Effects of the First Embodiment

According to the first embodiment, compensation voice information that is outputted when the packet buffer 101 is depleted is monitored, and a voice quality index reflecting a frequency of occurrence of compensation processing in voice decoding is obtained. Thus, a voice quality index that more closely matches actual voice quality may be conveniently obtained.

In this first embodiment, the compensation voice information determination section 110 of the voice information monitoring circuit 102 may obtain the voice quality index just by determining whether or not there is compensation voice information. That is, because there is no need to monitor headers of the voice packets or the like and determine packet losses, as mentioned above, the voice quality index may be obtained conveniently.

Even when there are time variations in the arriving voice packets, the quality of the decoded voice signal will be satisfactory provided the packet buffer 101 does not deplete. Time variations cause the quality of the voice signal to deteriorate when the packet buffer 101 starts to deplete. Therefore, this first embodiment, in which the quality index reflects whether or not the packet buffer 101 has depleted, may provide a voice quality index that matches actual voice quality, as mentioned above.

(B) Second Embodiment

Next, a second embodiment of the voice quality measurement device, method and program according to the present invention is described while referring to the attached drawings.

Figure 2:
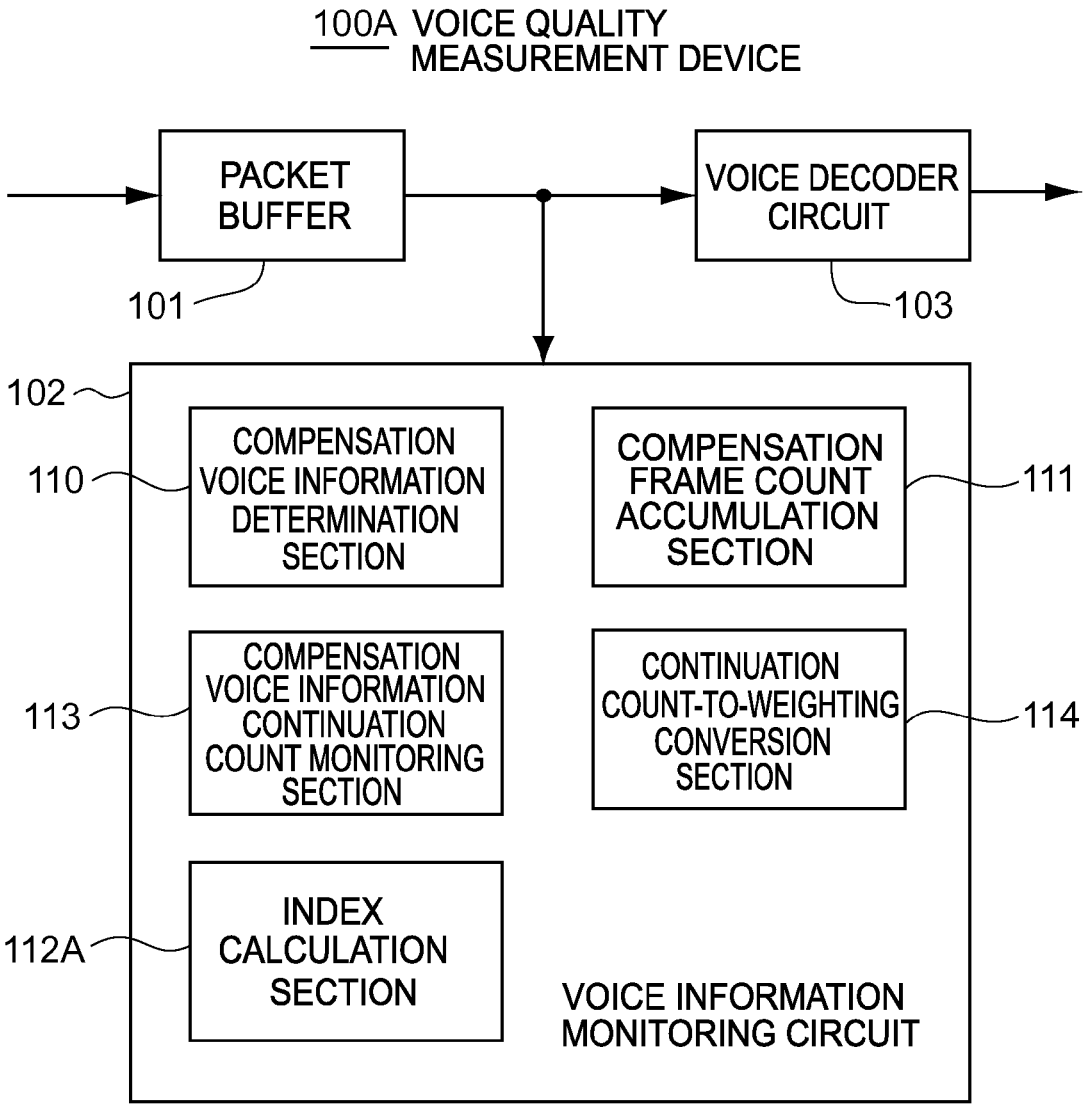
FIG. 2 is a block diagram illustrating functional structure of a voice quality measurement device relating to a second embodiment.

FIG. 2 is a block diagram illustrating functional structures of the voice quality measurement device of the second embodiment. Portions identical or corresponding to FIG. 1 relating to the first embodiment are labelled with identical or corresponding reference numerals.

In FIG. 2, a voice quality measurement device 100A of the second embodiment is constituted with the packet buffer 101 and a voice information monitoring circuit 102A. In the second embodiment, internal structure of the voice information monitoring circuit 102A differs from that of the voice information monitoring circuit 102 of the first embodiment.

The voice information monitoring circuit 102A of the second embodiment includes a compensation voice information continuation count monitoring section 113 and a continuation count-to-weighting conversion section 114, in addition to the compensation voice information determination section 110, the compensation frame count accumulation section 111 and an index calculation section 112A.

When the compensation voice information determination section 110 determines an output of compensation voice information from the packet buffer 101, the compensation voice information continuation count monitoring section 113 counts a number of continuations of compensation voice information included in this sequence of compensation voice information and, when continuation of this compensation voice information is interrupted, the compensation voice information continuation count monitoring section 113 supplies the continuation count to the continuation count-to-weighting conversion section 114. For example, a voice signal transmission side device system block and a voice signal reception side device (IP handset (IP telephone device)) system block are basically intended to run at the same rate, but if the voice signal reception side device (the IP handset) system block is faster than the voice signal transmission side device system block, there may be continuous compensation voice information. As another example, a relay device interposed in the voice communications transmits the voice packets in bursts, and if a period before a burst of voice packets arrives at the present device becomes quite long, there may be continuous compensation voice information.

The continuation count-to-weighting conversion section 114 converts the compensation voice information continuation count to a weighting W for calculating the voice quality index (W is a positive number smaller than 1). Now, if a number of frames of compensation voice information occurring in a measurement period is three, voice quality might deteriorate more if the three occur continuously than if they occur separately, even with the same number of frames of compensation voice information. Comparing a compensation accuracy corresponding to one frame of voice information with a compensation accuracy corresponding to three frames of voice information, the voice accuracy at the end of the three-frame voice information period is significantly worse. Therefore, the weighting W makes the value of the voice quality index N smaller as a continuation count is larger. Herein, a minimum continuation count after which the weighting W is outputted is two, but this is not limiting; a minimum continuation count may be suitably selected.

The index calculation section 112A of the second embodiment uses the weighting W provided from the continuation count-to-weighting conversion section 114 to calculate the voice quality index N of a current measurement period, as shown in expression (3).

$$N=W\cdot C/M \tag{3}$$

If continuations of compensation voice information occur plural times in the same measurement period, any of the following example methods may be employed. A first is to use an arithmetic product of the respective weightings as the weighting W in expression (3). A second is to use an arithmetic sum of the respective weightings as the weighting W in expression (3). A third is to use the weighting that corresponds to the continuation with the largest continuation count among the plural continuations as the weighting W in expression (3).

According to the second embodiment, compensation voice information that is outputted when the packet buffer 101 is depleted is monitored, and a voice quality index that both reflects a frequency of occurrence of compensation processing in voice decoding and reflects continuations of the compensation processing is obtained. Thus, a voice quality index that more closely matches actual voice quality may be conveniently obtained.

(C) Other Embodiments

In the embodiments described above, compensation voice information that is outputted when the packet buffer 101 is depleted is monitored, and a voice quality index reflecting compensation processing in voice decoding is obtained. In addition, other cases in which compensation processing is executed may be reflected in a voice quality index.

For example, packet losses in a network serve to reduce an accumulation amount of the packet buffer 101, but in the embodiments described above packet losses are not reflected in the voice quality index unless they lead to depletion of the packet buffer 101. Accordingly, a number of voice frames associated with lost packets that do not lead to depletion of the packet buffer 101 (which may be a voice frame count to which a weighting coefficient is applied) may be added to the accumulated value C for the calculation of the voice quality index N.

In this case, the compensation voice information determination section 110 may be provided with a function for monitoring sequence numbers of voice frames so as to detect packet losses, or packet loss information may be acquired from a packet loss detection circuit incorporated at the voice decoder circuit 103.

The above description refers to package losses in a network. However, packet losses that occur due to the packet buffer 101 filling up and discarding arriving voice packets may be dealt with in a similar manner.

The above embodiments show the voice quality index N being calculated from numbers of voice frames. However, the voice quality index N may be calculated from numbers of voice packets. In this case, the term at the right side of the above expression (1) is simply changed to a number of packets, and similar computational expressions may be employed.

The above embodiments show the voice quality index N being calculated on the basis of a number of occurrences of compensation voice information in a measurement period. However, the voice quality index N may be calculated on the basis of a time until a count value of occurrences of compensation voice information reaches a certain value.

The above embodiments show the packet buffer 101 accumulating a predetermined amount of voice information at the start, but this initial accumulation need not be performed. A deterioration in quality is similarly suppressed if, when jitter first occurs, accumulation equivalent to that jitter is performed, and the initial accumulation is only performed thereafter.

Voice processing devices in which the voice quality measurement device and the like of the present invention are installed are not limited to IP phone terminals (such as softphones), and may be other devices. For example, the voice quality measurement device and the like of the present invention may be installed at a router that is for connecting a legacy telephone terminal to an IP network.

The voice quality measurement program of the above embodiments may be stored at a recording medium that can be read from by a computer, such as a CD-ROM, a DVD-ROM, a USB (universal serial bus) memory or the like, and may be distributed through a communications system by wire and/or by wireless.

Embodiments of the present invention are described above, but the present invention is not limited to the embodiments as will be clear to those skilled in the art.

What is claimed is:

1. A voice quality measurement device that measures voice quality of a decoded voice signal outputted from a voice decoder unit, the device comprising:

a central processing unit (CPU) and a storage device configured to implement:

a packet buffer unit that accumulates non-periodically arriving voice packets as voice information and outputs the voice information to the voice decoder unit periodically; and a voice information monitoring unit that monitors continuity of the voice information inputted to the voice decoder unit and calculates an index of voice quality of the decoded voice signal that reflects acceptability of the continuity;

wherein the index that the voice information monitoring unit calculates is a proportion of decoder voice compensation processing, which is executed by the voice decoder unit, occurring in a unit of time; and wherein, if there is no voice information accumulated at a periodic output timing, the packet buffer unit outputs compensation processing request notice data at the periodic output timing, the compensation processing request notice data indicating that there is no voice information to output, and the voice information monitoring unit calculates the index, which is the proportion of decoder voice compensation processing executed by the voice decoder unit occurring in a unit of time, on the basis of the compensation processing request notice data.

2. The voice quality measurement device of claim 1, wherein the voice information monitoring unit includes a compensation frame count accumulation section that integrates an amount corresponding to a number of voice frames, corresponding to the voice packets, containing compensation voice information to an accumulated value.

3. The voice quality measurement device of claim 2, wherein the voice information monitoring unit further includes an index calculation section that calculates as the index a ratio of the accumulated value to a number of the voice frames occurring in a measurement period.

4. The voice quality measurement device of claim 3, wherein the index calculation section adjusts the index by subtracting the ratio from a predetermined value.

5. The voice quality measurement device of claim 2, wherein the voice information monitoring unit includes a continuation count-to-weighting conversion section that converts a compensation voice information continuation count to a weighting value for calculating the index, wherein the compensation voice information continuation count corresponds to a number of continuations of compensation voice information included in a measurement period.

6. The voice quality measurement device of claim 5, wherein the voice information monitoring unit further includes an index calculation section that calculates as the index a ratio, multiplied by the weighting value, of the accumulated value to a number of the voice frames occurring in a measurement period.

7. A voice quality measurement method that measures voice quality of a decoded voice signal outputted from a voice decoder unit, the method comprising:

accumulating non-periodically arriving voice packets as voice information and outputting the voice information to the voice decoder unit periodically; and monitoring continuity of the voice information inputted to the voice decoder unit and calculating an index of voice quality of the decoded voice signal that reflects acceptability of the continuity;

wherein calculating the index includes calculating a proportion of decoder voice compensation processing occurring in a unit of time; and wherein the method further comprises:

if there is no voice information accumulated at a periodic output timing, outputting compensation processing request notice data at the periodic output timing, the compensation processing request notice data indicating that there is no voice information to output, and calculating the index, which is the proportion of decoder voice compensation processing occurring in a unit of time, on the basis of the compensation processing request notice data.

8. The voice quality measurement method of claim 7, further comprising integrating an amount corresponding to a number of voice frames, corresponding to the voice packets, containing compensation voice information to an accumulated value.

9. The voice quality measurement method of claim 8, further comprising calculating as the index a ratio of the accumulated value to a number of the voice frames occurring in a measurement period.

10. The voice quality measurement method of claim 9, further comprising adjusting the index by subtracting the ratio from a predetermined value.

11. The voice quality measurement method of claim 8, further comprising converting a compensation voice information continuation count to a weighting value for calculating the index, wherein the compensation voice information continuation count corresponds to a number of continuations of compensation voice information included in a measurement period.

12. The voice quality measurement method of claim 11, further comprising calculating as the index a ratio, multiplied by the weighting value, of the accumulated value to a number of the voice frames occurring in a measurement period.

13. A non-transitory computer readable medium storing a voice quality measurement program to be installed at a voice processing device that includes a voice decoder unit that performs processing based on arriving voice packets, the program causing a computer installed at the voice processing device to execute a process for measuring voice quality of decoded voice signals outputted from the voice decoder unit, the process comprising:

accumulating non-periodically arriving voice packets as voice information and outputting the voice information to the voice decoder unit periodically; and monitoring continuity of the voice information inputted to the voice decoder unit and calculating an index of voice quality of the decoded voice signal that reflects acceptability of the continuity;

wherein calculating the index includes calculating a proportion of decoder voice compensation processing occurring in a unit of time; and wherein the process further comprises:

if there is no voice information accumulated at a periodic output timing, outputting compensation processing request notice data at the periodic output timing, the compensation processing request notice data indicating that there is no voice information to output, and calculating the index, which is the proportion of decoder voice compensation processing occurring in a unit of time, on the basis of the compensation processing request notice data.

14. The non-transitory computer-readable medium of claim 13, the process further comprising integrating an amount corresponding to a number of voice frames, corresponding to the voice packets, containing compensation voice information to an accumulated value.

15. The non-transitory computer-readable medium of claim 14, the process further comprising calculating as the index a ratio of the accumulated value to a number of the voice frames occurring in a measurement period.

16. The non-transitory computer-readable medium of claim 15, the process further comprising adjusting the index by subtracting the ratio from a predetermined value.

17. The non-transitory computer-readable medium of claim 14, the process further comprising converting a compensation voice information continuation count to a weighting value for calculating the index, wherein the compensation voice information continuation count corresponds to a number of continuations of compensation voice information included in a measurement period.

18. The non-transitory computer-readable medium of claim 17, the process further comprising calculating as the index a ratio, multiplied by the weighting value, of the accumulated value to a number of the voice frames occurring in a measurement period.

* * * * *